United States Patent [19]

Massa

[11] 4,028,504

[45] June 7, 1977

[54] ACOUSTIC AMPLIFIER COMBINED WITH TRANSDUCER SHOCK MOUNT

[75] Inventor: Frank Massa, Cohasset, Mass.

[73] Assignee: Fred M. Dellorfano, Jr., and Donald P. Massa, Trustees of The Stoneleigh Trust u/d/t, Cohasset, Mass.

[22] Filed: Nov. 12, 1975

[21] Appl. No.: 630,983

[52] U.S. Cl. ..... 179/146 R; 179/179

[51] Int. Cl.[2] ..... H04R 1/28

[58] Field of Search ..... 179/146 R; 181/179, 181/181

[56] References Cited

UNITED STATES PATENTS 3,947,646 3/1976 Saito ..... 179/146 R

*Primary Examiner*—William C. Cooper

[57] ABSTRACT

A molded rubber tubular member includes a grommet-like flange at its open end for permitting the structure to be attached to a panel. A recessed nest portion is provided at the opposite end of the tubular member into which is inserted a transducer whose diaphragm serves as a closure at the end of the tubular member. The assembly serves as a flexible shock mount for the transducer and also as an acoustic amplifier which increases the acoustic sensitivity of the transducer by 10 to 20 dB in a selective frequency band within the audible range.

8 Claims, 6 Drawing Figures

ACOUSTIC AMPLIFIER COMBINED WITH TRANSDUCER SHOCK MOUNT

This invention is concerned with improvements in an audio-frequency sound responsive system, and, more particularly, with means for increasing the sensitivity of the acoustic response of the system at a particular band of frequencies within the audible range. More specifically, this invention is concerned with an efficient low-cost vibration isolation mount for a transducer that serves the combined function of providing a flexible mounting structure for the transducer, and at the same time provides a controlled amount of acoustic amplification to the response characteristic of the transducer.

This invention is not limited in its application to a particular type of transducer or to a particular frequency region of operation, but it is most useful when applied to an audio system designed to operate with increased sensitivity within a specified band of frequencies located in the mid or upper audio range above approximately 500 Hz. It is also most effective when used with a transducer which is responsive to sound pressure and still more effective when the sound pressure responsive surface of the transducer lies in a plane.

The primary object of this invention is to provide a simple low-cost mounting structure for an electroacoustic transducer that serves both as a shock mount for the transducer and also as an acoustic amplifier which increases the sensitivity of the transducer within a desired frequency band.

Another object of this invention is to reduce the cost and improve the signal-to-noise ratio of a sound pressure detection system within a specified frequency band of operation.

These and other objects are accomplished by a preferred embodiment of the invention which may be understood best from a study of the following description and the accompanying drawings, in which.

Figure 1:
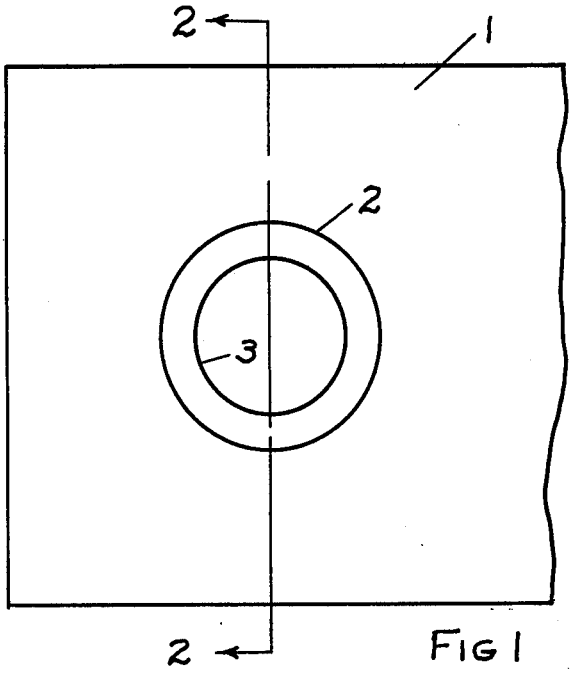
FIG. 1 is a schematic view illustrating the use of the inventive structure assembled to a panel to provide an effective shock mount for a microphone while also serving as an acoustic amplifier to increase the sensitivity of the microphone within a desired frequency band.
Figure 2:
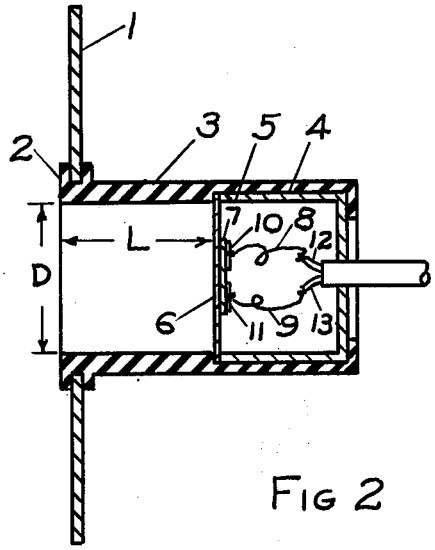
FIG. 2 is a section taken along the line 2—2 of FIG. 1.

Referring more specifically to the figures, the reference character 1 illustrates a panel such as is conventionally used for mounting control knobs and other apparatus on a typical electronic appliance. A flexible tubular structure 3 which is preferably molded of a rubber-like material includes a grommet-like portion 2 at one end, as illustrated in FIG. 2, which when pressed into a hole in the panel 1 serves to hold the tubular structure 3 securely in position. A recessed undercut region 4 at the opposite end of the tubular member 3 provides a flexible nest within which is inserted the transducer 5 where it is retained and remains accurately located within the tubular housing structure as illustrated. The flexible housing structure 3 into which the transducer is mounted serves to isolate the transducer from picking up mechanical vibrations from the panel.

The illustrative transducer 5 includes a sound pressure sensitive diaphragm 6 which provides a closure at one end of the tubular structure 3, as illustrated in FIG. 2. The periphery of the diagram 6 is rigidly attached to the transducer housing as illustrated in FIG. 2 in any conventional manner as is well known in the art. For the illustrative transducer, a piezoelectric ceramic disc 7 is bonded to the center of the diaphragm 6 using epoxy or any other suitable means. Flexible electrical leads 8 and 9 are soldered to the electrode surfaces of the ceramic 10 and 11 and also to the terminal conductors 12 and 13, as illustrated, to complete the assembly. The particular transducer structure illustrated is only one of many well-known structures that may be used in this invention; the only requirement for the transducer is that it preferably presents a sound pressure sensitive surface near the bottom end of the closed tubular cavity as illustrated in FIG. 2.

When the transducer is mounted as described, the diaphragm 6 forms a sealed closure at one end of the tubular structure 3 as illustrated in FIG. 2. The length of the opening L that remains in the tubular structure 3 after the transducer is assembled in place is dimensioned such that the size of the tubular cavity which results between the diaphragm and the opening in the tubular structure acts as an acoustic amplifier to increase the magnitude of the sound pressure at the transducer for the desired frequency region of operation over the sound pressure that would exist at the transducer if it were conventionally mounted with its diaphragm surface 6 flush with the surface of the panel 1. This increase in acoustic amplification at the desired frequency serves to increase the recognition threshold level of the sound signal which is to be detected by the system thus improving the signal-to-noise detection capability of the system in the presence of ambient background noise.

Figure 3:
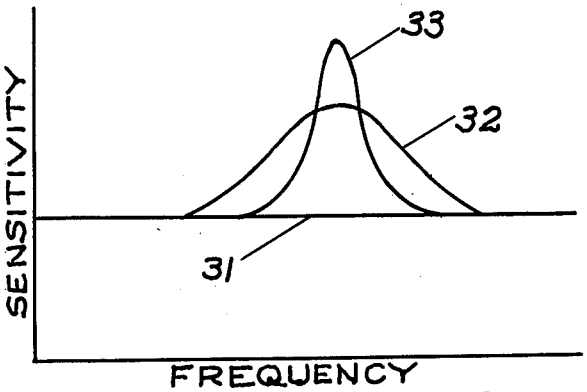
FIG. 3 illustrates the acoustic amplification characteristics which are achieved by the inventive structure.

FIG. 3 illustrates the increase in receiving response sensitivity that can be achieved for a transducer when mounted in the tubular housing as described. The horizontal line 31 represents the relative reference receiving sensitivity of the transducer when the diaphragm 6 is mounted in the conventional manner flush with the surface of the panel 1. The curves 32 and 33 illustrate the gain in receiving sensitivity that results from the acoustic amplification of the sound pressure that occurs at the diaphragm surface when the diaphragm is mounted into the recessed tubular cavity, as illustrated in the cross-sectional drawing in FIG. 2. The relative shape of the acoustic amplification gain characteristic, as illustrated by 32 and 33, is determined by the relative dimensions D and L (diameter and length) of the tubular cavity which is chosen for the mounting structure and also by the magnitude of the acoustic impedance which is presented by the transducer diaphragm in the frequency band in which the acoustic amplification is desired. In general, the higher the acoustic impedance of the diaphragm, the higher the acoustic gain that is achieved by the use of the inventive structure.

I have found that acoustic amplifications in excess of 10 dB can be obtained at any specified region within the audio-frequency range from approximately 1 kHz to 20 kHz if the transducer vibrating system is stiffness-controlled at the frequency at which the acoustic amplification is desired. For example, if the transducer employs a peripherally-clamped diaphragm as the vibrating system, as indicated in the illustrative example in FIG. 2, the acoustic amplification is generally higher if the resonant frequency of the diaphragm is designed to be above the desired operating frequency of the acoustic amplifier. I have also found that in order to build useful acoustic amplifiers for commercial applications that will produce sensitivity increases in the order of 10 dB to 20 dB for frequency bands in the order of 1/10 to ½ octave within the approximate audible frequency region 1 kHz to 20 kHz that the ratio of diameter to length of the tubular opening (D/L), as illustrated in FIG. 2, must lie within the approximate range ¼ to 4.

Figure 4:
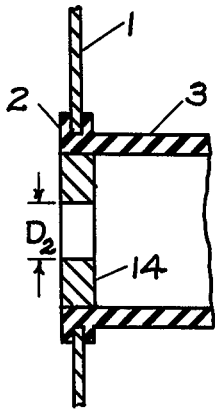
FIG. 4 illustrates a modification to the open end of the inventive structure for the purpose of changing the amplification characteristic of the system.
Figure 5:
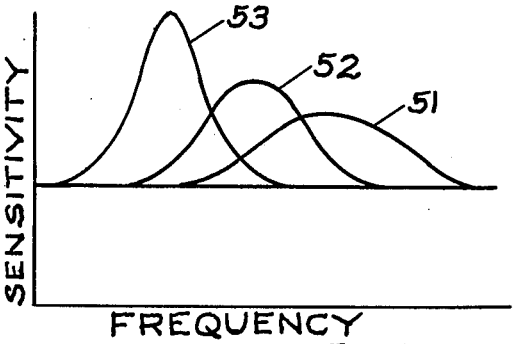
FIG. 5 shows the variations in acoustic amplification characteristics which may be achieved by the structural modification illustrated in FIG. 4.

Although the tubular opening illustrated in FIG. 2 is shown to be of uniform diameter D over the entire length L, it is not necessary that it be so maintained, nor is it intended that the invention be so restricted. For example, the diameter of the opening may be reduced to $D_2$, as illustrated in FIG. 4, by inserting the collar member 14, whereby the frequency region of acoustic amplification is lowered, as illustrated in FIG. 5. The change in the amplification characteristic as the diameter $D_2$ is progressively reduced is illustrated by the curves 51, 52 and 53, which indicate that as the diameter $D_2$ is reduced, the amplified frequency region is progressively lowered, the band width of the acoustic amplification becomes progressively narrower and the magnitude of the amplification becomes progressively higher as illustrated.

Figure 6:
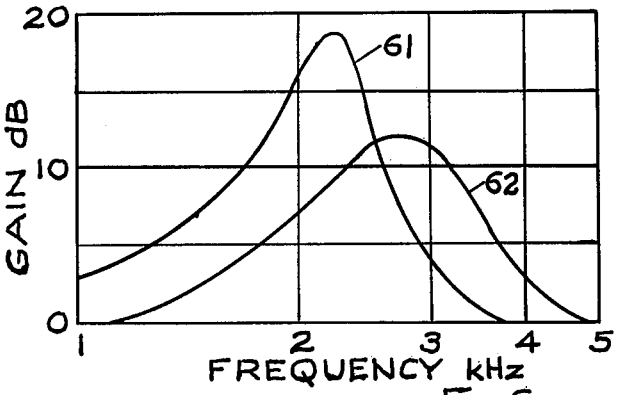
FIG. 6 shows the measured acoustic gain characteristics for a specific design of the inventive structure to serve a large scale commercial need.

The invention described has many useful applications. It is particularly useful in sound activated systems in which the presence of a low-level acoustic signal within a prescribed frequency region is to be detected over the general ambient noise level. A very successful commercial application is now making use of this invention to eliminate false alarms in a sound actuated intrusion detection system by greatly improving the signal-to-noise ratio of the acoustic receiver in a selective frequency region by making use of the selective acoustic amplification provided by the inventive structure. The actual measured acoustic gain obtained by two production designs utilizing the teachings of this invention and employing a molded rubber tubular member 3 as illustrated in FIG. 2 with the diameter D = ⅞ inches is shown in FIG. 6. The acoustic gain as shown by the response curve 61 was obtained for the condition L = 1-¼ inches and curve 62 was obtained for the condition L = ¾ inches. Further improvement in signal-to-noise ratio is achieved by the use of the low cost inventive structure because it also provides vibration isolation of the microphone from the panel structure. This further reduces ambient noise pickup which otherwise would be transmitted from the panel directly to the microphone if it was mounted directly on the panel instead of in the inventive structure.

Although I have chosen certain specific embodiments for illustrating the basic features of my invention, it will be obvious to those skilled in the art that numerous departures may be made in the specific details for executing the required functions and I, therefore, desire that my invention shall not be limited except insofar as is made necessary by the prior art and by the spirit of the appended claims.

I claim:

1. In combination in a sound detection system, an electro-acoustic transducer, an acoustic amplifier comprising a tubular member, a first mounting means associated with said tubular member for holding said transducer at one end of said tubular member, said transducer and said first mounting means characterized in that said mounted transducer forms a closure at said one end of said tubular member, and further characterized in that said closure presents a plane surface at right angles to the axis of said tubular member and still further characterized in that said plane surface extends to the inner wall surface of said tubular member, and a second mounting means associated with said tubular member for attaching said tubular member to a support structure.

2. The invention in claim 1 further characterized in that said tubular member is a flexible material.

3. The invention in claim 2 further characterized in that said first and said second mounting means are contiguous portions of the flexible tubular member.

4. The invention in claim 3 further characterized in that said first mounting means comprises a recessed region into the inner wall portion of said flexible tubular member and further characterized in that said transducer is mounted within said recessed region.

5. In combination, an electroacoustic transducer, a flexible tubular member having an opening at one end, means for attaching said electroacoustic transducer near the opposite end of said tubular member, said opposite end of said tubular member being effectively closed by said transducer, said flexible tubular member characterized in that the ratio of the inside diameter of said tubular member to the length of said tubular member between its open end and its closed end in the vicinity of the said attached transducer lies within the range 1 to 4 and 4 to 1.

6. The invention in claim 5 further characterized in that both the inside diameter of said tubular member and the length of said tubular member between its open end and the vicinity of the said attached transducer lie between the values ¼ inch and 4 inches.

7. The invention in claim 5 further characterized in that said tubular member provides acoustic amplification for said electroacoustic transducer within a selected frequency band lying within the audible frequency region above 500 Hz.

8. In combination in a sound detection system, an electroacoustic transducer, an acoustic amplifier comprising a tubular member, means associated with said tubular member for holding said transducer at one end of said tubular member whereby said mounted transducer forms a closure for said one end of said tubular member, means associated with said tubular member for attaching said tubular member to a support structure, said acoustic amplifier characterized in that it increases the sensitivity of said sound detection system within a selected frequency band lying within the audible frequency region above 500 Hz.

* * * * *